US009607584B2

(12) United States Patent
Mullins

(10) Patent No.: US 9,607,584 B2
(45) Date of Patent: Mar. 28, 2017

(54) REAL WORLD ANALYTICS VISUALIZATION

(71) Applicant: DAQRI, LLC, Los Angeles, CA (US)

(72) Inventor: Brian Mullins, Garden Grove, CA (US)

(73) Assignee: DAQRI, LLC, Los Angeles, CA (US)

( * ) Notice: Subject to any disclaimer, the term of this patent is extended or adjusted under 35 U.S.C. 154(b) by 82 days.

(21) Appl. No.: 13/840,359

(22) Filed: Mar. 15, 2013

(65) Prior Publication Data

US 2014/0267408 A1 Sep. 18, 2014

(51) Int. Cl.

| | |
|---|---|
| ***G09G 5/00*** | (2006.01) |
| ***G09G 5/377*** | (2006.01) |
| ***G09G 3/00*** | (2006.01) |

(52) U.S. Cl.

CPC ..... *G09G 5/377* (2013.01); *G09G 3/001* (2013.01); *G09G 3/003* (2013.01); *G09G 2370/022* (2013.01)

(58) Field of Classification Search

CPC ..... G06T 19/006
USPC ..... 345/633
See application file for complete search history.

(56) References Cited

U.S. PATENT DOCUMENTS

| | | | | |
|---|---|---|---|---|
| 8,250,065 | B1 * | 8/2012 | Chambers | G06F 17/30873 707/723 |
| 8,606,645 | B1 * | 12/2013 | Applefeld | G06Q 30/02 705/14.25 |
| 2007/0150527 | A1 * | 6/2007 | Takakura et al. | 707/204 |
| 2009/0240735 | A1 | 9/2009 | Grandhi et al. | |
| 2010/0188503 | A1 * | 7/2010 | Tsai et al. | 348/142 |
| 2011/0217685 | A1 | 9/2011 | Srinivasan et al. | |
| 2011/0246064 | A1 * | 10/2011 | Nicholson | 701/206 |
| 2012/0026192 | A1 * | 2/2012 | Lim | 345/633 |
| 2012/0117232 | A1 | 5/2012 | Brown et al. | |
| 2012/0120070 | A1 * | 5/2012 | Baillot | 345/419 |
| 2012/0221639 | A1 | 8/2012 | Mallet et al. | |
| 2012/0263154 | A1 * | 10/2012 | Blanchflower | G06F 17/30247 370/338 |
| 2013/0060641 | A1 * | 3/2013 | Al Gharabally | 705/14.66 |
| 2013/0069990 | A1 * | 3/2013 | Geise et al. | 345/660 |

(Continued)

FOREIGN PATENT DOCUMENTS

| | | | |
|---|---|---|---|
| EP | 2312517 | A1 | 4/2011 |
| EP | 2972952 | A1 | 1/2016 |
| WO | WO-2014150969 | A1 | 9/2014 |

OTHER PUBLICATIONS

Lehrburger (Where Do you Go—Create a Heat Map of Your Foursquare Check-Ins, http://www.wheredoyougo.net/, 2009).*

(Continued)

*Primary Examiner* — Kyle Zhai
(74) *Attorney, Agent, or Firm* — Schwegman Lundberg & Woessner, P.A.

(57) ABSTRACT

A server receives and analyzes analytics data from an application of one or more devices. The application corresponds to a content generator. The server generates, using the content generator, a visualization content dataset based on the analysis of the analytics data. The visualization content dataset comprises a set of images, along with corresponding analytics virtual object models to be engaged with an image of a physical object captured with the one or more devices and recognized in the set of images. The analytics data and the visualization content dataset may be stored in a storage device of the server.

20 Claims, 10 Drawing Sheets

(56) References Cited

U.S. PATENT DOCUMENTS

| | | | | |
|---|---|---|---|---|
| 2013/0293530 | A1* | 11/2013 | Perez | G06K 9/00671 345/418 |
| 2013/0335573 | A1* | 12/2013 | Forutanpour | G06F 3/011 348/158 |
| 2014/0015858 | A1* | 1/2014 | Chiu | 345/633 |

OTHER PUBLICATIONS

"International Application Serial No. PCT/US2014/024670, International Search Report mailed Jul. 29, 2014", 3 pgs.
"International Application Serial No. PCT/US2014/024670, Written Opinion mailed Jul. 29, 2014", 5 pgs.
"International Application Serial No. PCT/US2014/024670, International Preliminary Report on Patentability mailed Sep. 24, 2015", 7 pgs.
"European Application Serial No. 14770915.8, Extended European Search Report mailed Jun. 15, 2016", 9 pgs.
"Australian Application Serial No. 2014235416, First Examiner Report mailed Jan. 17, 2017", 2 pgs.

* cited by examiner

REAL WORLD ANALYTICS VISUALIZATION

TECHNICAL FIELD

The subject matter disclosed herein generally relates to the processing of data. Specifically, the present disclosure addresses systems and methods for real world analytics visualization.

BACKGROUND

A device can be used to generate and display data in addition an image captured with the device. For example, augmented reality (AR) is a live, direct or indirect, view of a physical, real-world environment whose elements are augmented by computer-generated sensory input such as sound, video, graphics or GPS data. With the help of advanced AR technology (e.g. adding computer vision and object recognition) the information about the surrounding real world of the user becomes interactive. Device-generated (e.g., artificial) information about the environment and its objects can be overlaid on the real world.

BRIEF DESCRIPTION OF THE DRAWINGS

Some embodiments are illustrated by way of example and not limitation in the figures of the accompanying drawings.

DETAILED DESCRIPTION

Example methods and systems are directed to real world analytics visualization. Examples merely typify possible variations. Unless explicitly stated otherwise, components and functions are optional and may be combined or subdivided, and operations may vary in sequence or be combined or subdivided. In the following description, for purposes of explanation, numerous specific details are set forth to provide a thorough understanding of example embodiments. It will be evident to one skilled in the art, however, that the present subject matter may be practiced without these specific details.

A server receives and analyzes analytics data from an augmented reality application of one or more devices. The consuming application corresponds to an experience generator. The server generates, using the experience generator, a visualization content dataset based on the analysis of the analytics data. The visualization content dataset comprises a set of images, along with corresponding analytics virtual object models to be overlaid on an image of a physical object captured with the one or more devices and recognized in the set of images. The analytics data and the visualization content dataset may be stored in a storage device of the server.

Augmented reality applications allow a user to experience information, such as in the form of a three-dimensional virtual object overlaid on a picture of a physical object captured by a camera of a device. The physical object may include a visual reference that the augmented reality application can identify. A visualization of the additional information, such as the three-dimensional virtual object overlaid or engaged with an image of the physical object is generated in a display of the device. The three-dimensional virtual object may selected based on the recognized visual reference. A rendering of the visualization of the three-dimensional virtual object may be based on a position of the display relative to the visual reference.

A contextual local image recognition module in the device retrieves a primary content dataset from a server. The primary content dataset comprises a first set of images and corresponding three-dimensional analytics virtual object models. For example, the first set of images may include most common images that a user of the device is likely to capture with the device. The contextual content dataset comprises a second set of images and corresponding three-dimensional analytics virtual object models retrieved from the server. The contextual local image recognition module generates and updates the contextual content dataset based an image captured with the device. A storage device of the device stores the primary content dataset and the contextual content dataset.

Figure 1:
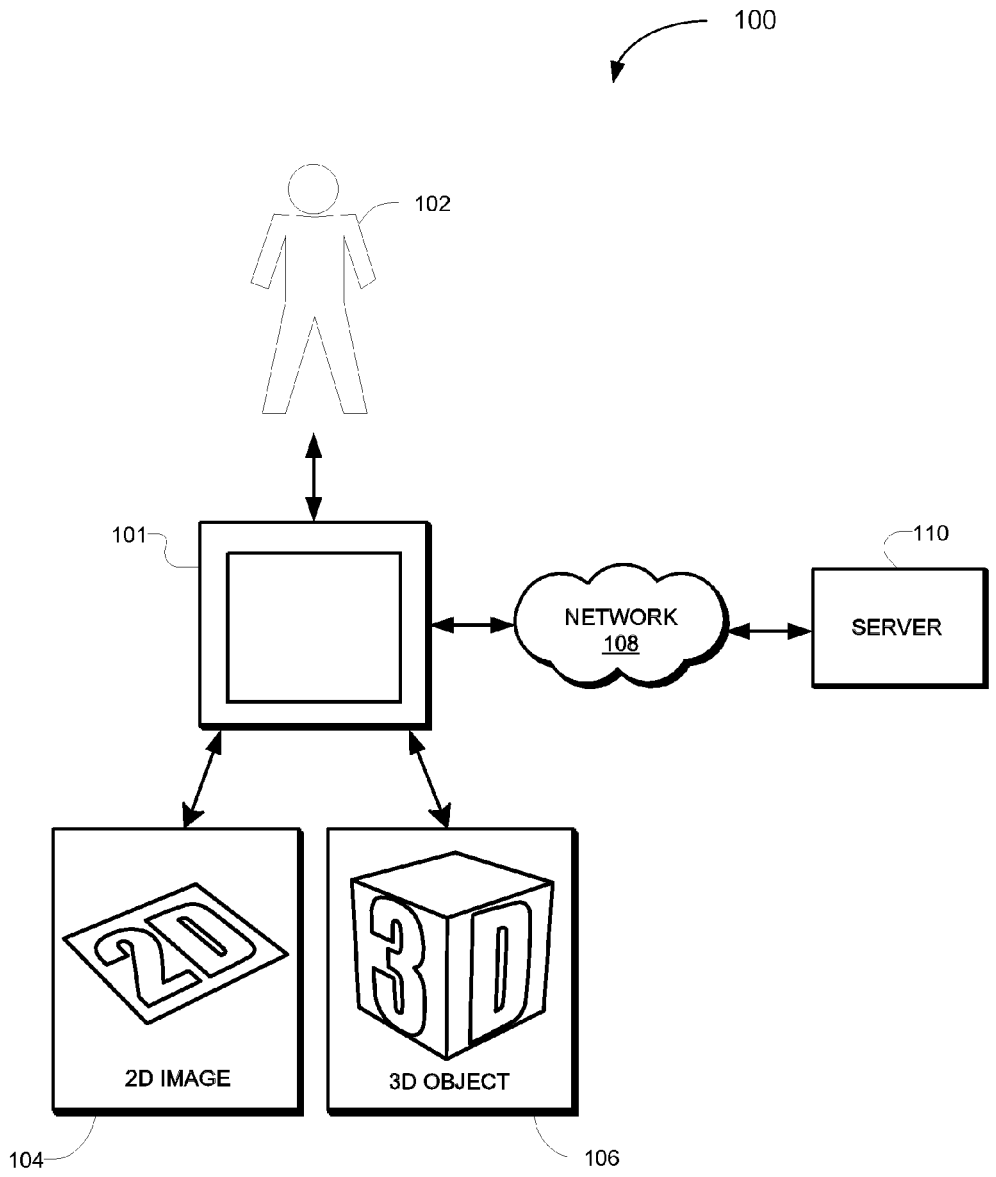
FIG. 1 is a block diagram illustrating an example of a network suitable for operating a real world analytics visualization server, according to some example embodiments.

FIG. 1 is a network diagram illustrating a network environment 100 suitable for operating an augmented reality application of a device, according to some example embodiments. The network environment 100 includes a device 101 and a server 110, communicatively coupled to each other via a network 108. The device 101 and the server 110 may each be implemented in a computer system, in whole or in part, as described below with respect to FIG. 7.

The server 110 may be part of a network-based system. For example, the network-based system may be or include a cloud-based server system that provides additional information such, as three-dimensional models, to the device 101.

FIG. 1 illustrates a user 102 using the device 101. The user 102 may be a human user (e.g., a human being), a machine user (e.g., a computer configured by a software program to interact with the device 101), or any suitable combination thereof (e.g., a human assisted by a machine or a machine supervised by a human). The user 102 is not part of the network environment 100, but is associated with the device 101 and may be a user 102 of the device 101. For example, the device 101 may be a desktop computer, a vehicle computer, a tablet computer, a navigational device, a portable media device, or a smart phone belonging to the user 102.

The user 102 may be a user of an application in the device 101. The application may include an augmented reality application configured to provide the user 102 with an experience triggered by a physical object, such as, a two-dimensional physical object 104 (e.g., a picture) or a three-dimensional physical object 106 (e.g., a statue). For example, the user 102 may point a camera of the device 101 to capture an image of the two-dimensional physical object 104. The image is recognized locally in the device 101 using a local context recognition dataset module of the augmented reality application of the device 101. The augmented reality application then generates additional information corresponding to the image (e.g., a three-dimensional model) and presents this additional information in a display of the device 101 in response to identifying the recognized image. If the captured image is not recognized locally at the device 101, the device 101 downloads additional information (e.g., the three-dimensional model) corresponding to the captured image, from a database of the server 110 over the network 108.

The device 101 may capture and submit analytics data to the server 110 for further analysis on usage and how the user 102 is interacting with the physical object. For example, the analytics data may track at what the locations (e.g., points or features) on the physical or virtual object the user 102 has looked, how long the user 102 has looked at each location on the physical or virtual object, how the user 102 held the device 101 when looking at the physical or virtual object, which features of the virtual object the user 102 interacted with (e.g., such as whether a user 102 tapped on a link in the virtual object), and any suitable combination thereof. The device 101 receives a visualization content dataset 222 related to the analytics data. The device 101 then generates a virtual object with additional or visualization features, or a new experience, based on the visualization content dataset 222.

Any of the machines, databases, or devices shown in FIG. 1 may be implemented in a general-purpose computer modified (e.g., configured or programmed) by software to be a special-purpose computer to perform one or more of the functions described herein for that machine, database, or device. For example, a computer system able to implement any one or more of the methodologies described herein is discussed below with respect to FIG. 12. As used herein, a "database" is a data storage resource and may store data structured as a text file, a table, a spreadsheet, a relational database (e.g., an object-relational database), a triple store, a hierarchical data store, or any suitable combination thereof. Moreover, any two or more of the machines, databases, or devices illustrated in FIG. 1 may be combined into a single machine, and the functions described herein for any single machine, database, or device may be subdivided among multiple machines, databases, or devices.

The network 108 may be any network that enables communication between or among machines (e.g., server 110), databases, and devices (e.g., device 101). Accordingly, the network 108 may be a wired network, a wireless network (e.g., a mobile or cellular network), or any suitable combination thereof. The network 108 may include one or more portions that constitute a private network, a public network (e.g., the Internet), or any suitable combination thereof.

Figure 2:
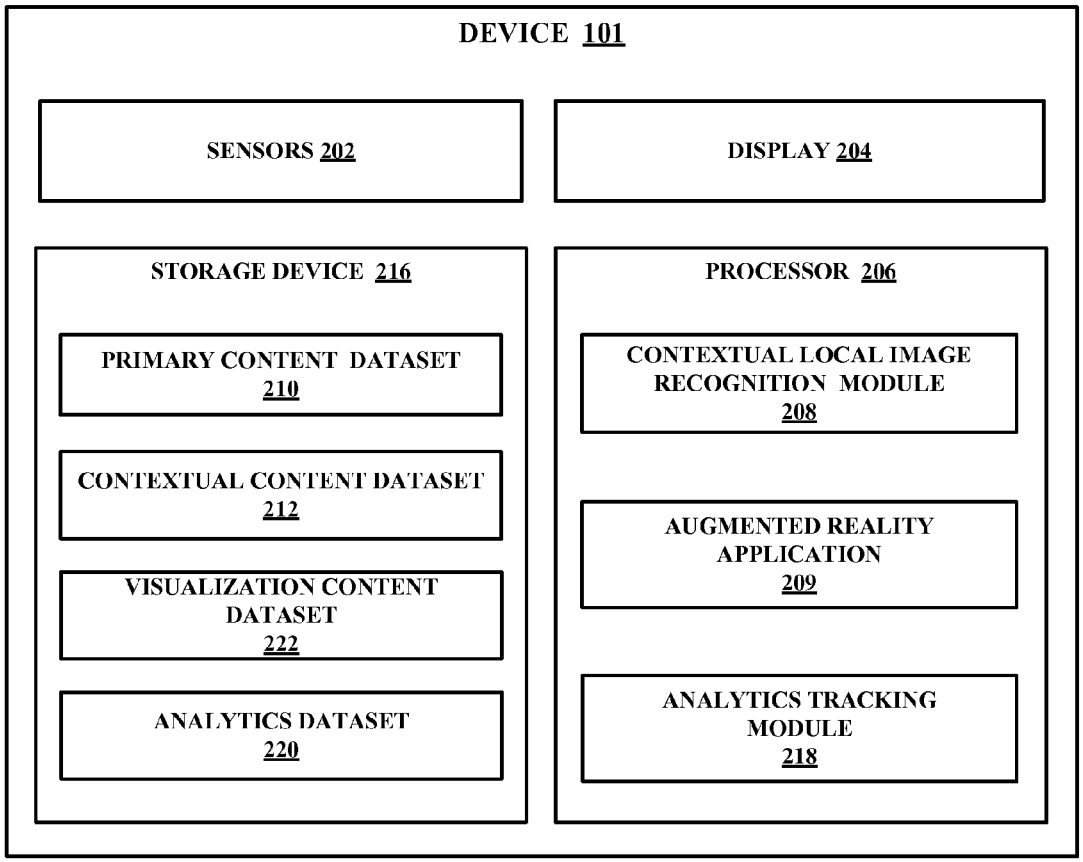
FIG. 2 is a block diagram illustrating modules (e.g., components) of a device, according to some example embodiments.

FIG. 2 is a block diagram illustrating modules (e.g., components) of the device 101, according to some example embodiments. The device 101 may include sensors 202, a display 204, a processor 206, and a storage device 216. For example, the device 101 may be a desktop computer, a vehicle computer, a tablet computer, a navigational device, a portable media device, or a smart phone of a user. The user may be a human user (e.g., a human being), a machine user (e.g., a computer configured by a software program to interact with the device 101), or any suitable combination thereof (e.g., a human assisted by a machine or a machine supervised by a human).

The sensors 202 may include, for example, a proximity sensor, an optical sensor (e.g., camera), an orientation sensor (e.g., gyroscope), an audio sensor (e.g., a microphone), or any suitable combination thereof. For example, the sensors 202 may include a rear facing camera and a front facing camera in the device 101. It is noted that the sensors described herein are for illustration purposes and the sensors 202 are thus not limited to the ones described.

The display 204 may include, for example, a touchscreen display configured to receive a user input via a contact on the touchscreen display. In another example, the display 204 may include a screen or monitor configured to display images generated by the processor 206.

The processor 206 may include a contextual local image recognition module 208, a consuming application such as an augmented reality application 209, and an analytics tracking module 218.

The augmented reality application 209 may generate a visualization of a three-dimensional virtual object overlaid (e.g., superimposed upon, or otherwise displayed in tandem with) on an image of a physical object captured by a camera of the device 101 in the display 204 of the device 101. A visualization of the three-dimensional virtual object may be manipulated by adjusting a position of the physical object (e.g., its physical location, orientation, or both) relative to the camera of the device 101. Similarly, the visualization of the three-dimensional virtual object may be manipulated by adjusting a position camera of the device 101 relative to the physical object.

In one embodiment, the augmented reality application 209 communicates with the contextual local image recognition module 208 in the device 101 to retrieve three-dimensional models of virtual objects associated with a captured image (e.g., a virtual object that corresponds to the captured image. For example, the captured image may include a visual reference (also referred to as a marker) that consists of an identifiable image, symbol, letter, number, machine-readable code. For example, the visual reference may include a bar code, a quick response (QR) code, or an image that has been previously associated with a three-dimensional virtual object (e.g., an image that has been previously determined to correspond to the three-dimensional virtual object).

The contextual local image recognition module 208 may be configured to determine whether the captured image matches an image locally stored in a local database of images and corresponding additional information (e.g., three-dimensional model and interactive features) on the device 101. In one embodiment, the contextual local image recognition module 208 retrieves a primary content dataset from the server 110, generates and updates a contextual content dataset based an image captured with the device 101.

The analytics tracking module 218 may track analytics data related to how the user 102 is engaged with the physical object. For example, the analytics tracking module 218 may track at the location on the physical or virtual object the user 102 has looked, how long the user 102 has looked at each location on the physical or virtual object, how the user 102 held the device 101 when looking at the physical or virtual object, which features of the virtual object the user 102 interacted with (e.g., such as whether a user tapped on a link in the virtual object), or any suitable combination thereof.

The storage device 216 may be configured to store a database of visual references (e.g., images) and corresponding experiences (e.g., three-dimensional virtual objects, interactive features of the three-dimensional virtual objects). For example, the visual reference may include a machine-readable code or a previously identified image (e.g., a picture of shoe). The previously identified image of the shoe may correspond to a three-dimensional virtual model of the shoe that can be viewed from different angles by manipulating the position of the device 101 relative to the picture of the shoe. Features of the three-dimensional virtual shoe may include selectable icons on the three-dimensional virtual model of the shoe. An icon may be selected or activated by tapping or moving on the device 101.

In one embodiment, the storage device 216 includes a primary content dataset 210, a contextual content dataset 212, a visualization content dataset 222, and an analytics dataset 220.

The primary content dataset 210 includes, for example, a first set of images and corresponding experiences (e.g., interaction with three-dimensional virtual object models). For example, an image may be associated with one or more virtual object models. The primary content dataset 210 may include a core set of images or the most popular images determined by the server 110. The core set of images may include a limited number of images identified by the server 110. For example, the core set of images may include the images depicting covers of the ten most popular magazines and their corresponding experiences (e.g., virtual objects that represent the ten most popular magazines). In another example, the server 110 may generate the first set of images based on the most popular or often scanned images received at the server 110. Thus, the primary content dataset 210 does not depend on objects or images scanned by the augmented reality application 209 of the device 101.

The contextual content dataset 212 includes, for example, a second set of images and corresponding experiences (e.g., three-dimensional virtual object models) retrieved from the server 110. For example, images captured with the device 101 that are not recognized (e.g., by the device 101) in the primary content dataset 210 are submitted to the server 110 for recognition. If the captured image is recognized by the server 110, a corresponding experience may be downloaded at the device 101 and stored in the contextual content dataset 212. Thus, the contextual content dataset 212 relies on the context in which the device 101 has been used. As such, the contextual content dataset 212 depends on objects or images scanned by the augmented reality application 209 of the device 101.

The analytics dataset 220 corresponds to analytics data collected by the analytics tracking module 218.

The visualization content dataset 222 includes, for example, a visualization set of images and corresponding experiences downloaded from the server 110 based on the analytics data collected by the analytics tracking module 218.

In one embodiment, the device 101 may communicate over the network 108 with the server 110 to retrieve a portion of a database of visual references, corresponding three-dimensional virtual objects, and corresponding interactive features of the three-dimensional virtual objects. The network 108 may be any network that enables communication between or among machines, databases, and devices (e.g., the device 101). Accordingly, the network 108 may be a wired network, a wireless network (e.g., a mobile or cellular network), or any suitable combination thereof. The network 108 may include one or more portions that constitute a private network, a public network (e.g., the Internet), or any suitable combination thereof.

Any one or more of the modules described herein may be implemented using hardware (e.g., a processor of a machine) or a combination of hardware and software. For example, any module described herein may configure a processor to perform the operations described herein for that module. Moreover, any two or more of these modules may be combined into a single module, and the functions described herein for a single module may be subdivided among multiple modules. Furthermore, according to various example embodiments, modules described herein as being implemented within a single machine, database, or device may be distributed across multiple machines, databases, or devices.

Figure 3:
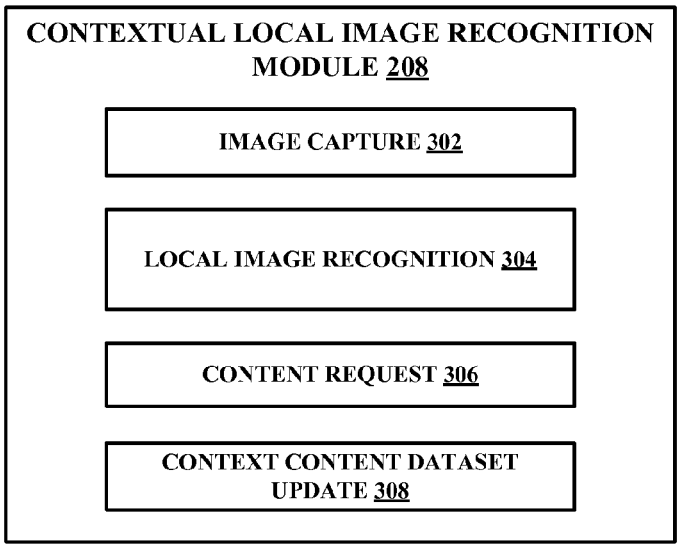
FIG. 3 is a block diagram illustrating modules (e.g., components) of a contextual local image recognition module, according to some example embodiments.

FIG. 3 is a block diagram illustrating modules (e.g., components) of a contextual local image recognition module 208, according to some example embodiments. The contextual local image recognition module 208 may include an image capture module 302, a local image recognition module 304, a content request module 306, and a context content dataset update module 308.

The image capture module 302 may capture an image with a lens of the device 101. For example, the image capture module 302 may capture the image of a physical object pointed at by the device 101. In one embodiment, the image capture module 302 may capture one image or a series of snapshots. In another embodiment, the image capture module 302 may capture an image when sensors 202 (e.g., vibration, gyroscope, compass, etc.) detect that the device 101 is no longer moving.

The local image recognition module 304 determines that the captured image correspond to an image stored in the primary content dataset 210. The augmented reality application 209 then locally renders the three-dimensional analytics virtual object model corresponding to the recognized image captured with the device 101.

In another example embodiment, the local image recognition module 304 determines that the captured image corresponds to an image stored in the contextual content dataset 212. The augmented reality application 209 then locally renders the three-dimensional analytics virtual object model corresponding to the image captured with the device 101.

The content request module 306 may request the server 110 for the three-dimensional analytics virtual object model corresponding to the image captured with the device 101 based on the image captured with the device 101 not corresponding to one of the set of images in the primary content dataset 210 and the contextual content dataset 212 in the storage device 216.

The context content dataset update module 308 may receive the three-dimensional analytics virtual object model corresponding to the image captured with the device 101 from the server 110 in response to the request generated by the content request module 306. In one embodiment, the context content dataset update module 308 may update the contextual content dataset 212 with the three-dimensional analytics virtual object model corresponding to the image captured with the device 101 from the server 110 based on the image captured with the device 101 not corresponding to any images stored locally in the storage device 216 of the device 101.

In another embodiment, the content request module 306 may determine usage conditions of the device 101 and generate a request to the server 110 for a third set of images and corresponding three-dimensional virtual object models based on the usage conditions. The usage conditions may fully or partially indicate when, how often, where, and how the user 102 is using the device 101. The context content dataset update module 308 may update the contextual content dataset 212 with the third set of images and corresponding three-dimensional virtual object models.

For example, the content request module 306 determines that the user 102 scans pages of a newspaper in the morning time. The content request module 306 then generates a request to the server 110 for a set of images and corresponding experiences that are relevant to usage of the user 102 in the morning. For example, the content request module 306 may retrieve images of sports articles that the user 102 is most likely to scan in the morning and a corresponding updated virtual score board of a sports team mentioned in one of the sports articles. The experience may include, for example, a fantasy league score board update that is personalized to the user 102.

In another example, the content request module 306 determines that the user 102 often scans the business section of a newspaper. The content request module 306 then generates a request to the server 110 for a set of images and corresponding experiences that are relevant to the user 102. For example, the content request module 306 may retrieve images of business articles of the next issue of the newspaper as soon as the next issue's business articles are available. The experience may include, for example, a video report corresponding to an image of the next issue business article.

In yet another example embodiment, the content request module 306 may determine social information of the user 102 of the device 101 and generate a request to the server 110 for another set of images and corresponding three-dimensional virtual object models based on the social information. The social information may be obtained from a social network application in the device 101. The social information may include fully or partially who the user 102 has interacted with, who the user 102 has shared experiences using the augmented reality application 209 of the device 101. The context content dataset update module 308 may update the contextual content dataset 212 with the other set of images and corresponding three-dimensional virtual object models.

For example, the user 102 may have scanned several pages of a magazine. The content request module 306 determines from a social network application that the user 102 is friend with another user who share similar interests and reads another magazine. As such, the content request module 306 may generate a request to the server 110 for a set of images and corresponding experiences related to the other magazine (e.g., category, field of interest, format, publication schedule).

In another example, if the content request module 306 determines that the user 102 has scanned one or two images from the same magazine, the content request module 306 may generate a request for additional content from other images in the same magazine.

Figure 4:
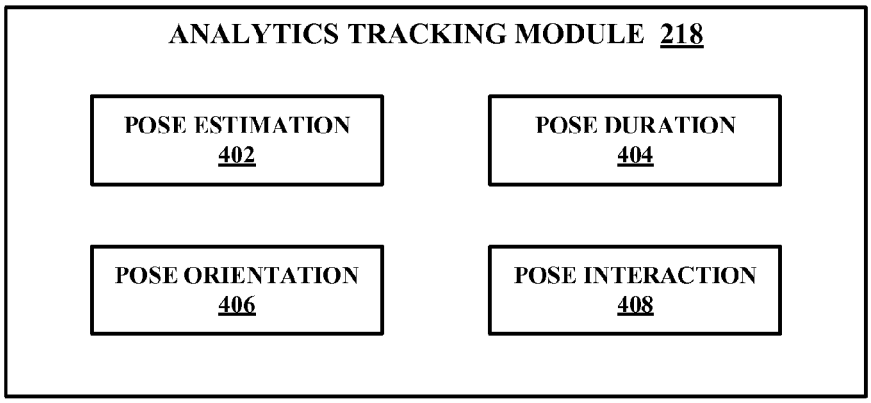
FIG. 4 is a block diagram illustrating modules (e.g., components) of an analytics tracking module, according to some example embodiments.

FIG. 4 is a block diagram illustrating modules (e.g., components) of the analytics tracking module 218, according to some example embodiments. The analytics tracking module 218 includes a pose estimation module 402, a pose duration module 404, a pose orientation module 406, and a pose interaction module 408. The pose may include how and how long the device 101 is held in related a physical object.

The pose estimation module 402 may be configured to detect the location on a virtual object or physical object the device 101 is aiming at. For example, the device 101 may aim at the top of a virtual statue generated by aiming the device 101 at the physical object 104. In another example, the device 101 may aim at the shoes of a person in a picture of a magazine.

The pose duration module 404 may be configured to determine a time duration within which the device 101 is aimed (e.g., by the user 102) at a same location on the physical or virtual object. For example, the pose duration module 404 may measure the length of the time the user 102 has aimed and maintained the device 101 at the shoes of a person in the magazine. Sentiment and interest in the shoes may be inferred based on the length of the time the user 102 has held the device 101 aimed at the shoes.

The pose orientation module 406 may be configured to determine an orientation of the device 101 aimed (e.g., by the user 102) at the physical or virtual object. For example, the pose orientation module 406 may determine that the user 102 is holding the device 101 in a landscape mode, and thus may infer a sentiment or interest of the user 102 based on the landscape orientation of the device 101.

The pose interaction module 408 may be configured to determine interactions of the user 102 on the device 101 with respect to the virtual object corresponding to the physical object. For example, the virtual object may include features such as virtual menus or buttons. When the user 102 taps on the virtual button, a browser application in the device 101 is launched to a preselected website associated with the tapped virtual dialog box. The pose interaction module 408 may measure and determine which buttons the user 102 has tapped on, the click through rate for each virtual button, websites visited by the user 102 from the augmented reality application 209, and so forth. The pose interaction module may also measure other interactions (e.g., when the application was used, which features was used, which button for tapped) between the user 102 and the augmented reality application 209.

Figure 5:
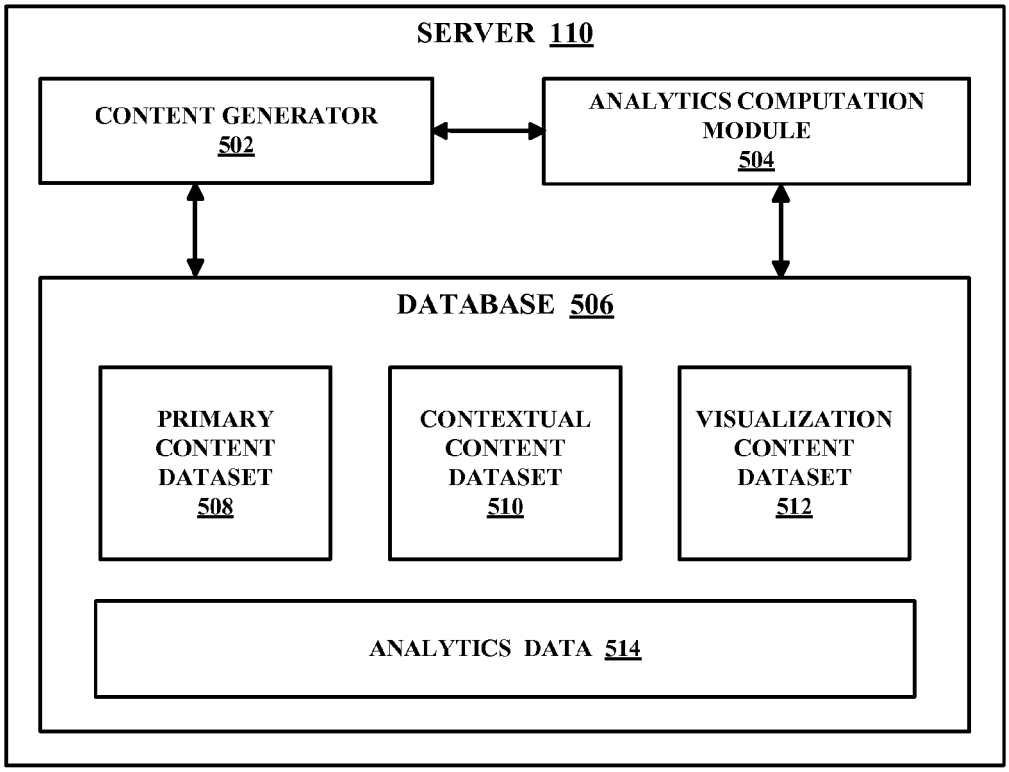
FIG. 5 is a block diagram illustrating modules (e.g., components) of a server, according to some example embodiments.

FIG. 5 is a block diagram illustrating modules (e.g., components) of the server 110, according to some example embodiments. The server 110 includes an experience generator 502, an analytics computation module 504, and a database 506.

The experience generator 502 may generate a analytics virtual object model to be rendered in the display 204 of the device 101 based on a position of the device 101 relative to the physical object. The visualization of the virtual object corresponding to the analytics virtual object model, which may be engaged with the recognized image of the physical object captured with the device 101. The virtual object corresponds to the recognized image. In other words, each image may have its own unique virtual object.

The analytics computation module 504 may analyze a pose estimation of the device 101 relative to the physical object captured with the device 101, the pose duration of the device 101 relative to the physical object captured with the device 101, the pose orientation of the device 101 relative to the physical object captured with the device 101, and the pose interaction of the device 101 relative to the physical object captured with the device 101. As previously described, the pose estimation may include a location on the physical or virtual object aimed by the device 101. The pose duration may include a time duration within which the device 101 is aimed at a same location on the physical or virtual object. The pose orientation may identify an orientation of the device 101 aimed at the physical or virtual object. The pose interaction may identify interactions of the user 102 on the device 101 with respect the virtual object corresponding to the physical object.

The database 506 may store a primary content dataset 508, a contextual content dataset 510, a visualization content dataset 512, and analytics data 514.

The primary content dataset 508 may store a primary content dataset 508 and a contextual content dataset 510. The primary content dataset 508 comprises a first set of images and corresponding virtual object models. The experience generator 502 determines that a captured image received from the device 101 is not recognized in the primary content dataset 508, and generates the contextual content dataset 510 for the device 101. The contextual content dataset 510 may include a second set of images and corresponding virtual object models.

The visualization content dataset 512 includes data generated based on the analysis of the analytics data 514 by the analytics computation module 504. The visualization content dataset 512 may include a set of images, corresponding analytics virtual object models to be engaged with an image of a physical object captured with the device 101 and recognized in the set of images.

For example, a "heat map" dataset corresponding to a page of a magazine may be generated. The "heat map" may be a virtual map displayed on the device 101 when aimed at the corresponding page. The "heat map" may indicate areas most looked at by users.

In another example, the analytics virtual object model may include a virtual object whose behavior, state, color, or shape depend on the analytics results corresponding to an image of a physical object. For example, a real time image of a page of a shoe catalog may be overlaid with virtual information that could show which shoe on the page is sold the most, mostly viewed, or selected. As a result, a virtual object (e.g., an enlarged 3D model of the shoe, a virtual flag pin, a virtual arrow) corresponding to the image of the most popular shoe on the catalog page may be generated and displayed. Least popular shoes on the page would have a corresponding smaller virtual object (e.g., a smaller 3D model of the shoe). As such, when the user points the device to the catalog page, the user may see several 3D models of shoes from the catalog page floating about an image of the catalog page. Each 3D shoe model may float above its corresponding shoe picture in the catalog page. In another example, only the most popular shoe may be generated and displayed on the device looking at the image of the catalog page.

The analytics virtual object may include one or more virtual object model that are generated based on the analytics results of an image of a physical object.

The analytics data 514 may include the analytics data gathered from devices 101 having the augmented reality application 209 installed.

In one embodiment, the experience generator 502 generates the visualization content dataset 512 for multiple devices based on the pose estimation, the pose duration, the pose orientation, and the pose interaction from multiple devices.

In another embodiment, the experience generator 502 generates the visualization content dataset 512 for a device 101 based on the pose estimation, the pose duration, the pose orientation, and the pose interaction from the device 101.

Figure 6:
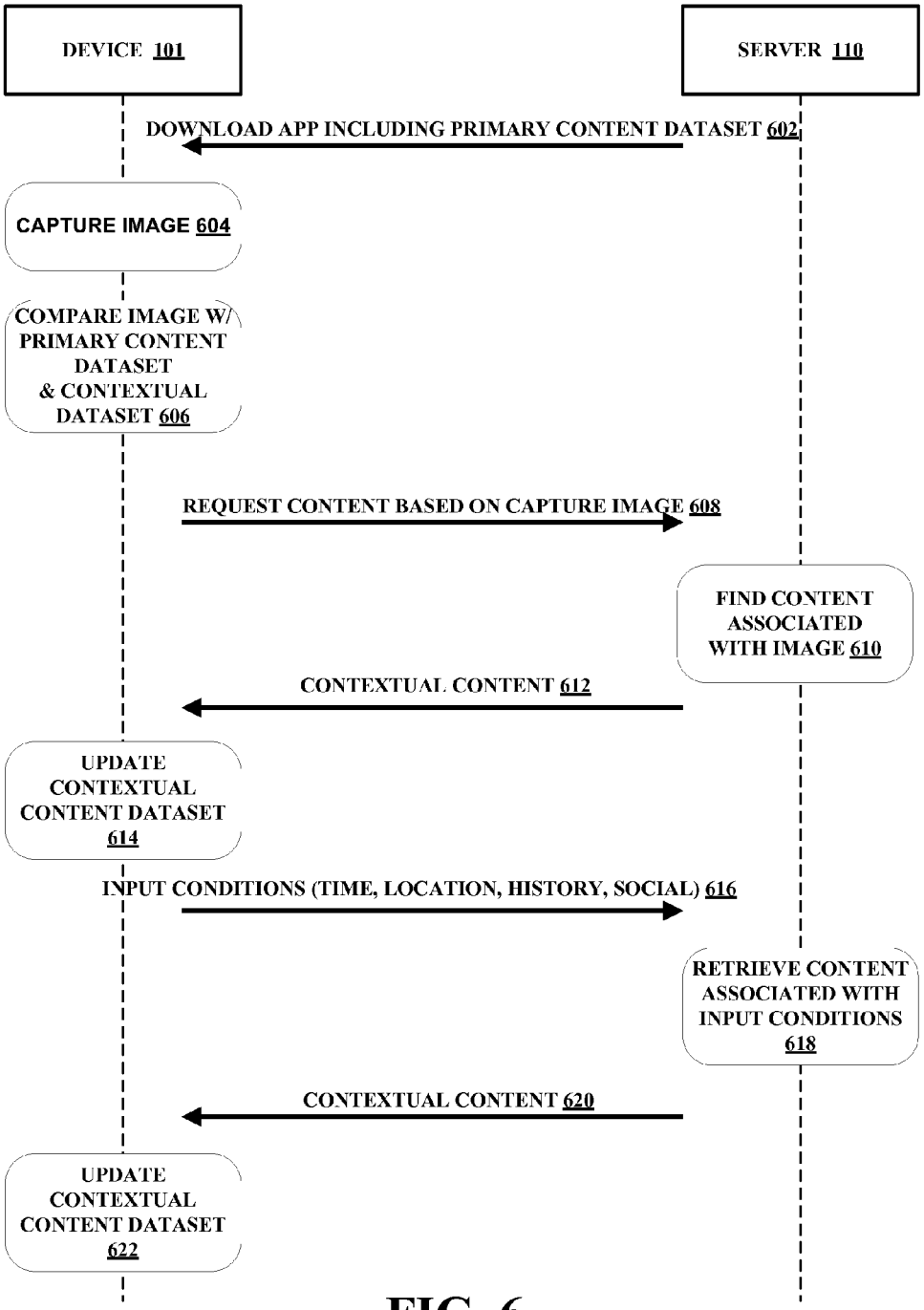
FIG. 6 is a ladder diagram illustrating an operation of the contextual local image recognition module of the device, according to some example embodiments.

FIG. 6 is a ladder diagram illustrating an operation of the contextual local image recognition module 208 of the device 101, according to some example embodiments. At operation 602, the device 101 downloads an augmented reality application 209 from the server 110. The augmented reality application 209 may include the primary content dataset 210. The primary content dataset 210 may include for example, the most often scanned pictures of ten popular magazines and corresponding experiences. At operation 604, the device 101 captures an image.

At operation 606, the device 101 compares the captured image with local images from the primary content dataset 210 and from a contextual content dataset 212. If the captured image is not recognized in both the primary content dataset and the contextual content dataset, the device 101 requests the server 110 at operation 608 to retrieve content or an experience associated with the captured image.

At operation 610, the server 110 identifies the captured image and retrieves content associated with the captured image.

At operation 612, the device 101 downloads the content corresponding to the captured image, from the server 110.

At operation 614, the device 101 updates its local storage to include the content. In one embodiment, the device 101 updates its contextual content dataset 212 with the downloaded content from operation 612.

In another example embodiment, input conditions from the device 101 are submitted to the server 110 at operation 616. The input conditions may include usage time information, location information, a history of scanned images, and social information. The server 110 may retrieve content associated with the input conditions at operation 618. For example, if the input conditions indicate that the user 102 operates the device 101 mostly from location A. Content relevant to location A (e.g., restaurants nearby) may be retrieved from the server 110.

At operation 620, the device 101 downloads the content retrieved in operation 418 and updates the contextual content dataset based on the retrieved content.

Figure 7:
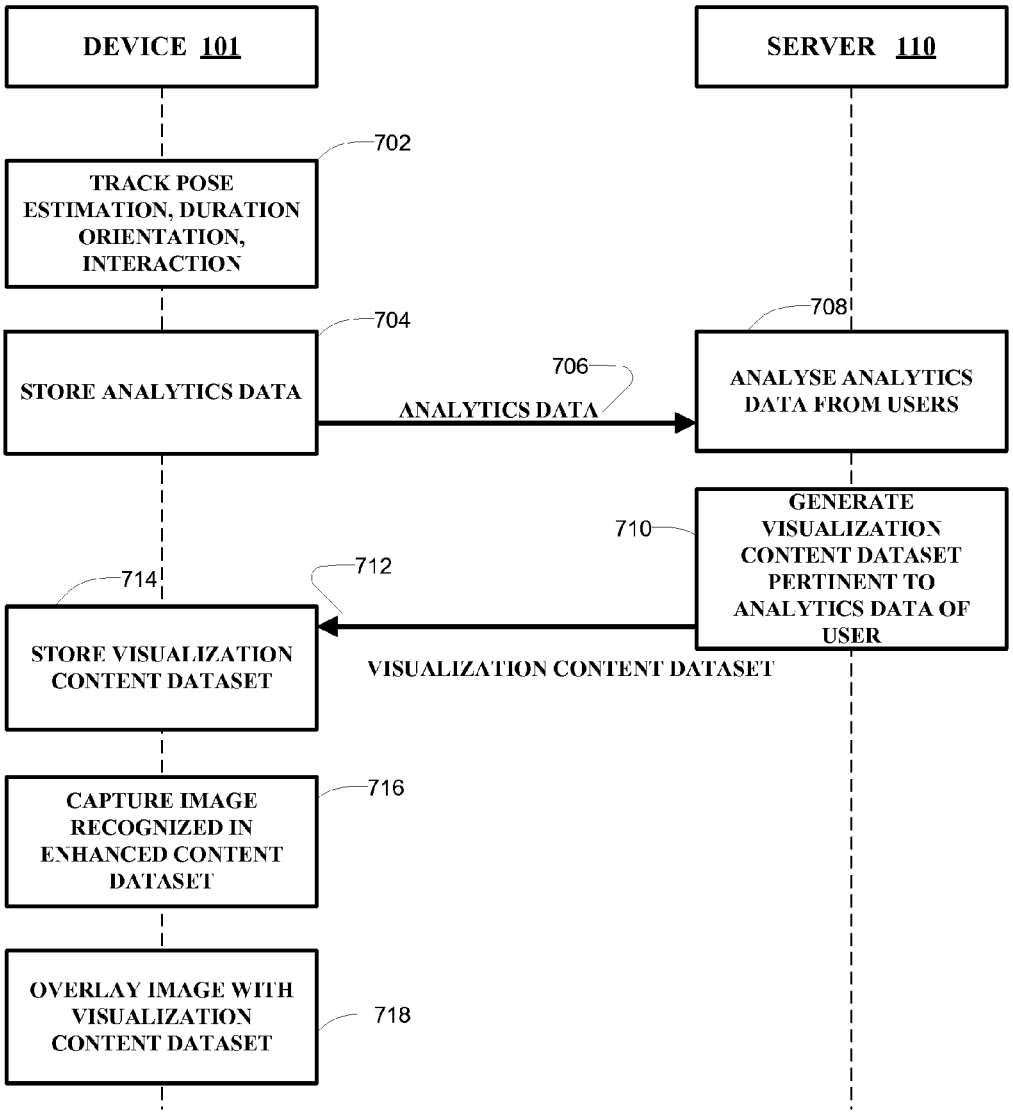
FIG. 7 is a ladder diagram illustrating an operation of the real world analytics visualization server, according to some example embodiments.

FIG. 7 is a ladder diagram illustrating an operation of the real world analytics visualization server 110, according to some example embodiments. At operation 702, the device 101 tracks pose estimation, duration, orientation, and interaction. At operation 704, the device 101 may store the analytics data locally in a storage unit of the device 101. At operation 706, the device 101 sends the analytics data 514 to the server 110 for analysis. At operation 708, the server 110 analyzes the analytics data 514 from one or more devices (e.g., device 101). For example, the server 110 may track a newspaper page area mostly viewed by multiple devices. In another example, the server 110 may track a magazine page area mostly viewed by multiple devices or for a relatively long period of time (e.g., above average time from multiple devices) by a single device 101.

At operation 710, the server 110 generates visualization content dataset 512 pertinent to the analytics data from a user of a mobile device or from many users of mobile devices.

At operation 712, the server 110 sends the visualization content dataset 512 to the device 101. The device 101 may store the visualization content dataset 512 at operation 714. At operation 716, the device 101 captures an image recognized by in the visualization content dataset 222. At operation 718, the device 101 generates a visualization experience based on the visualization content dataset 222. For example, a "heatmap" may display areas most often looked by users for the physical object. The heatmap may be a virtual map overlaid on top of an image of the physical object to for elements (e.g., labels, icons, colored indicators) of the heatmap to correspond to an image of the physical object.

Figure 8:
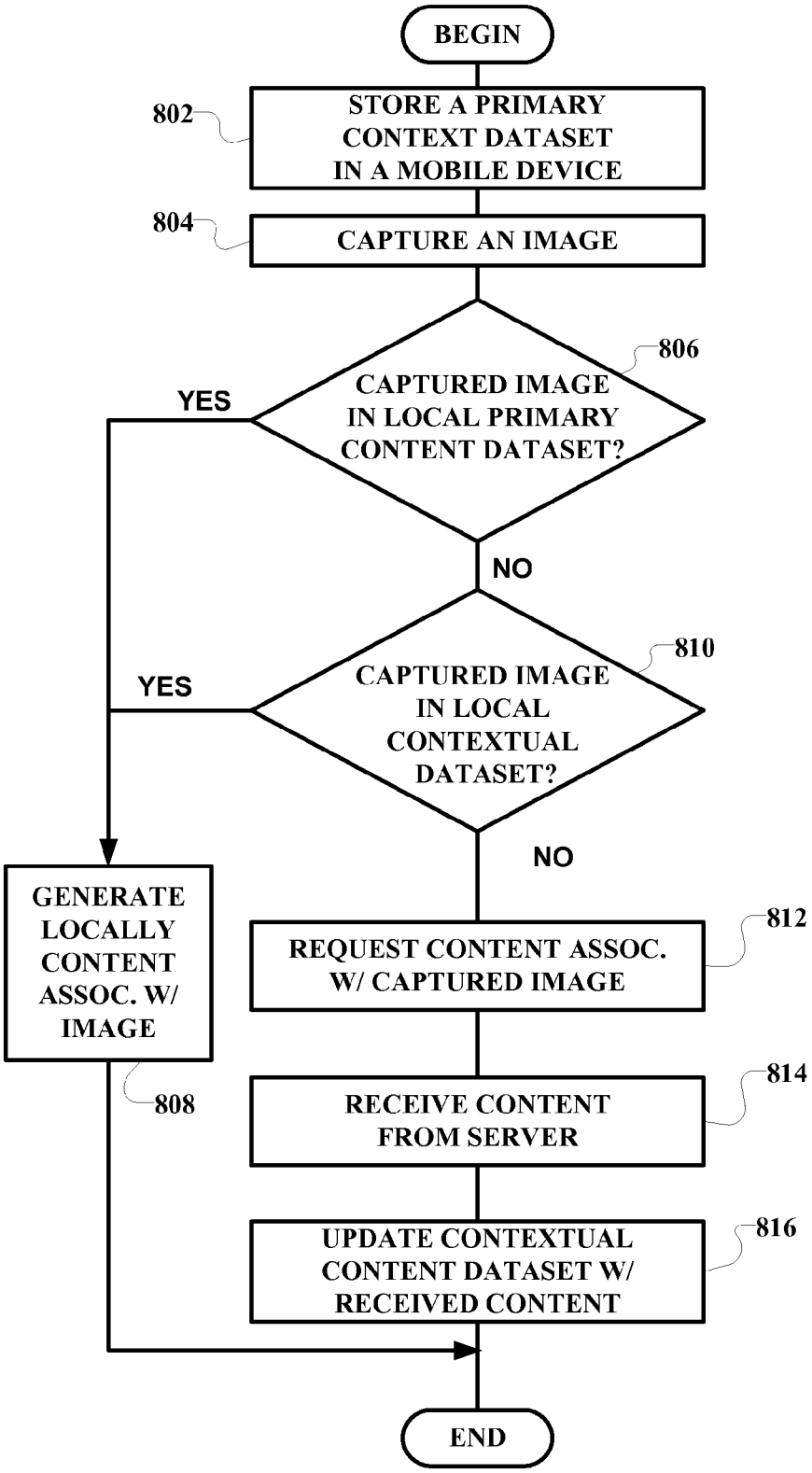
FIG. 8 is a flowchart illustrating an example operation of the contextual local image recognition dataset module of the device, according to some example embodiments.

FIG. 8 is a flowchart illustrating an example operation of the contextual local image recognition module 208 of the device 101, according to some example embodiments.

At operation 802, the contextual local image recognition dataset module 208 stores the primary content dataset 210 in the device 101.

At operation 804, the augmented reality application 209 determines that an image has been captured with the device 101.

At operation 806, the contextual local image recognition dataset module 208 compares the captured image with a set of images locally stored in the primary content dataset 210 in the device 101. If the captured image corresponds to an image from the set of images locally stored in the primary content dataset 210 in the device 101, the augmented reality application 209 generates an experience based on the recognized image at operation 808.

If the captured image does not correspond to an image from the set of images locally stored in the primary content dataset 210 in the device 101, the contextual local image recognition module 208 compares the captured image with a set of images locally stored in the contextual content dataset in the device 101 at operation 810.

If the captured image corresponds to an image from the set of images locally stored in the contextual content dataset 212 in the device 101, the augmented reality application 209 generates an experience based on the recognized image at operation 808.

If the captured image does not correspond to an image from the set of images locally stored in the contextual content dataset 212 in the device 101, the contextual local image recognition module 208 submits a request including the captured image to the server 110 at operation 812.

At operation 814, the device 101 receives content corresponding to the captured image from the server 110.

At operation 816, the contextual local image recognition module 208 updates the contextual content dataset 212 based on the received content.

Figure 9:
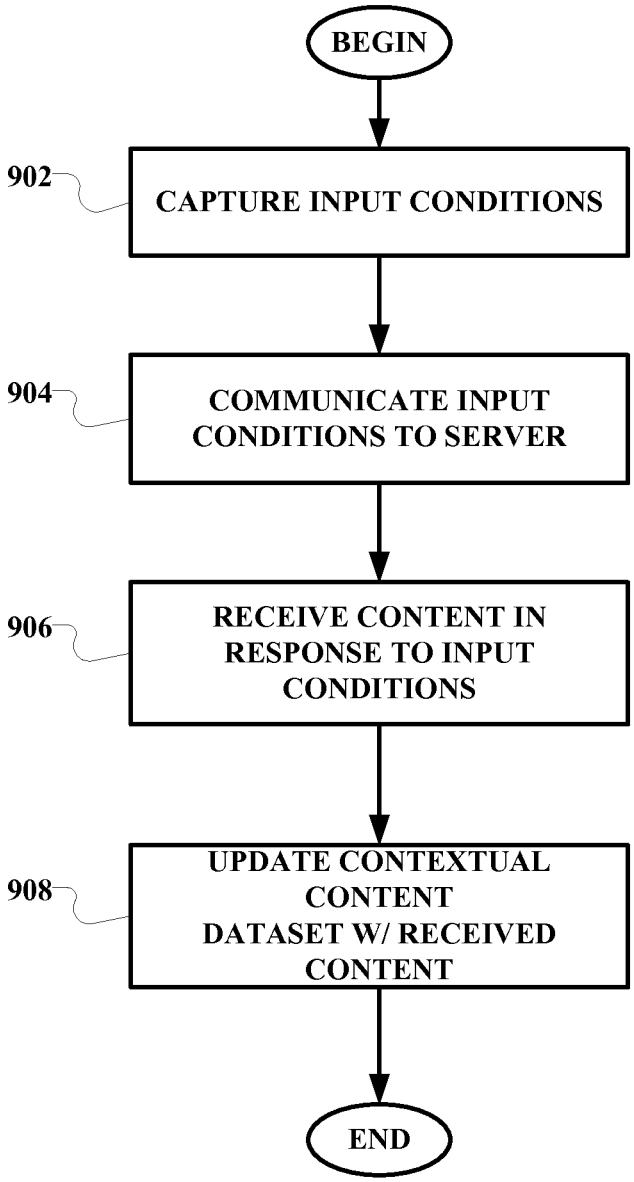
FIG. 9 is a flowchart illustrating another example operation of the contextual local image recognition dataset module of the device, according to some example embodiments.

FIG. 9 is a flowchart illustrating another example operation of the contextual local image recognition module of the device, according to some example embodiments.

At operation 902, the contextual local image recognition module 208 captures input conditions of the device 101. As previously described, input conditions may include usage time information, location information, history of scanned images, and social information.

At operation 904, the contextual local image recognition module 208 communicates the input conditions to the server 110. At operation 906, the server 110 retrieves new content related to the input conditions of the device 101.

At operation 908, the contextual local image recognition dataset module 208 updates the contextual content dataset 212 with the new content.

Figure 10:
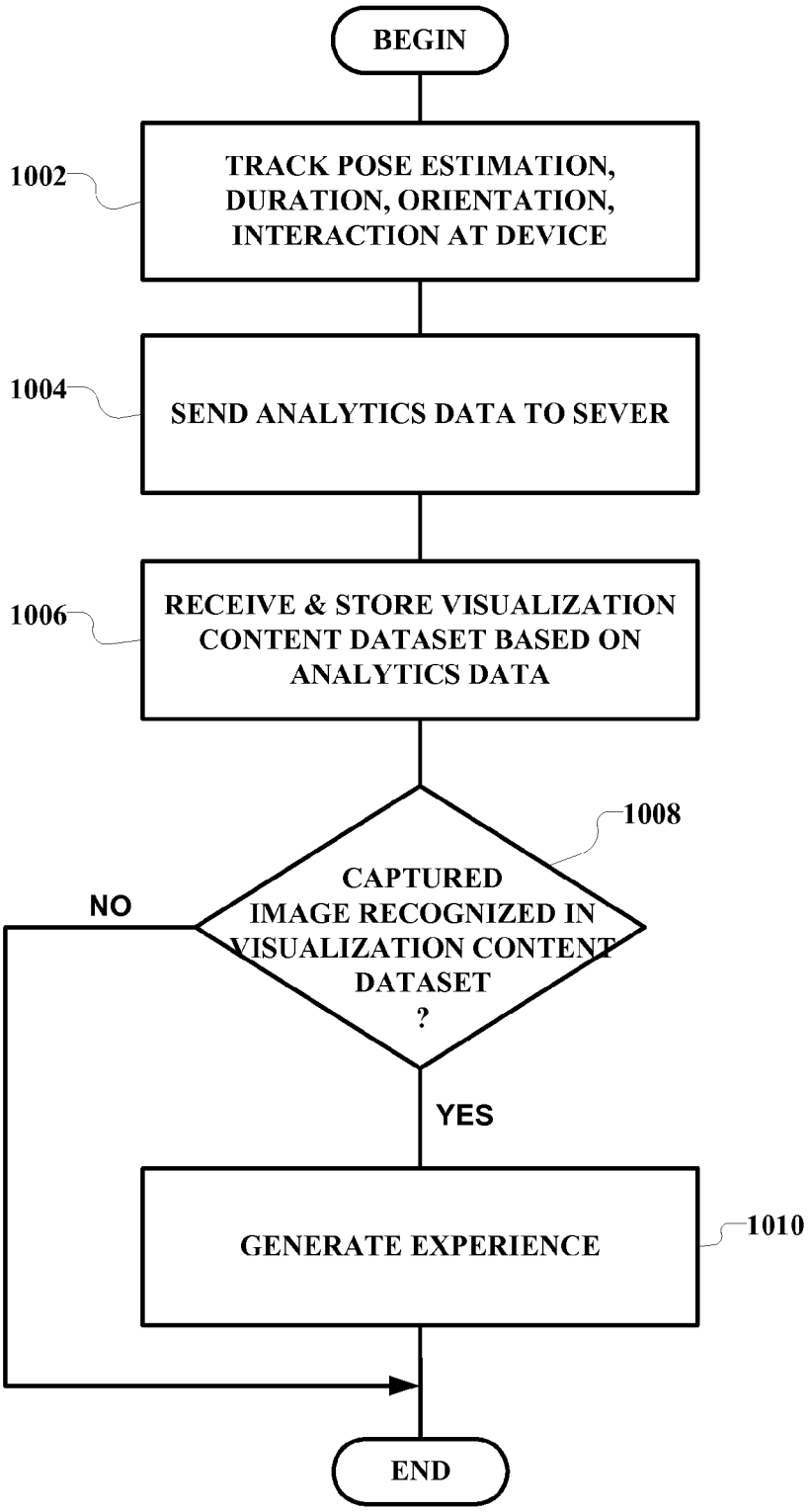
FIG. 10 is a flowchart illustrating another example operation of real world analytics visualization at the device, according to some example embodiments.

FIG. 10 is a flowchart illustrating another example operation 1000 of real world analytics visualization at the device 101, according to some example embodiments. At operation 1002, the analytics tracking module 218 of the device 101 tracks a pose estimation, duration, orientation, and interaction at the device 101.

At operation 1004, the analytics tracking module 218 of the device 101 sends the analytics data to the server 110. At operation 1006, the augmented reality application 209 of the device 101 receives visualization content dataset based on the analytics data. At operation 1008, the augmented reality application 209 of the device 101 determines whether an image captured by the device 101 is recognized in the visualization content dataset 222. If the captured image is recognized in the visualization content dataset 222, the augmented reality application 209 of the device 101 generates the visualization experience.

Figure 11:
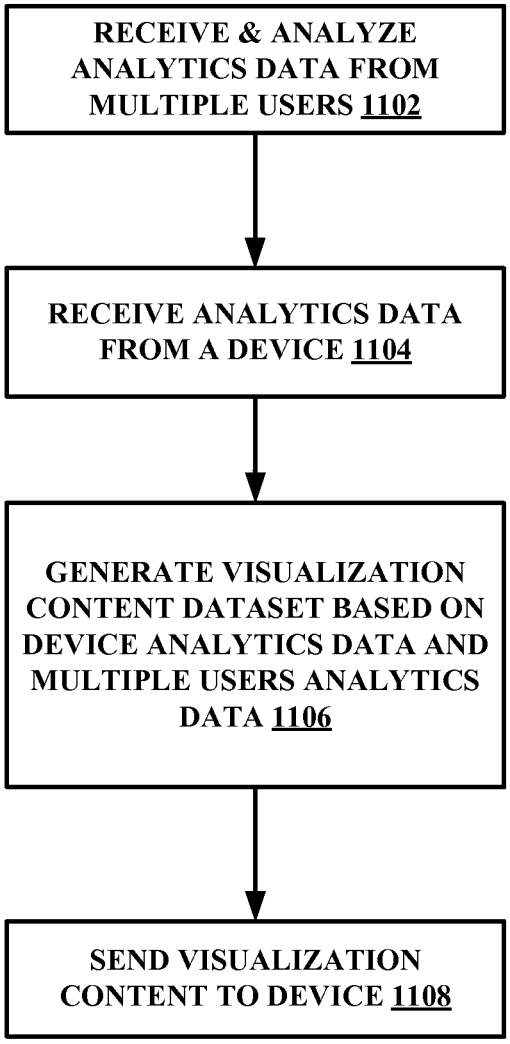
FIG. 11 is a flowchart illustrating another example operation of real world analytics visualization at the server, according to some example embodiments.

FIG. 11 is a flowchart illustrating another example operation 1100 of real world analytics visualization at the server, according to some example embodiments.

At operation 1102, the analytics computation module 504 of the server 110 receives and aggregates analytics data from users (e.g., user 102) of devices (e.g., user 101), each executing the augmented reality application 209. At operation 1104, the analytics computation module 504 of the server 110 receives analytics data from a device of a user (e.g., user 102 of the device 101). At operation 1106, the content generator 502 of the server 110 generates visualization content dataset 512 based on the aggregate analytics data and the analytics data of the particular device. For example, the visualization content data 512 may include an analytics virtual object models that correspond to an image of a physical object. The analytics virtual object models may be used to generate a virtual map, or virtual display, virtual object showing the results of an analytical computation on analytics data collected from users. Thus, for example, a restaurant with high ratings may have a larger virtual object (e.g., bigger virtual sign than other restaurant virtual sign) overlaid on an image of the restaurant in the display of the device.

At operation 1108, the experience module 502 of the server 110 sends the visualization content dataset 512 to the particular device.

Figure 12:
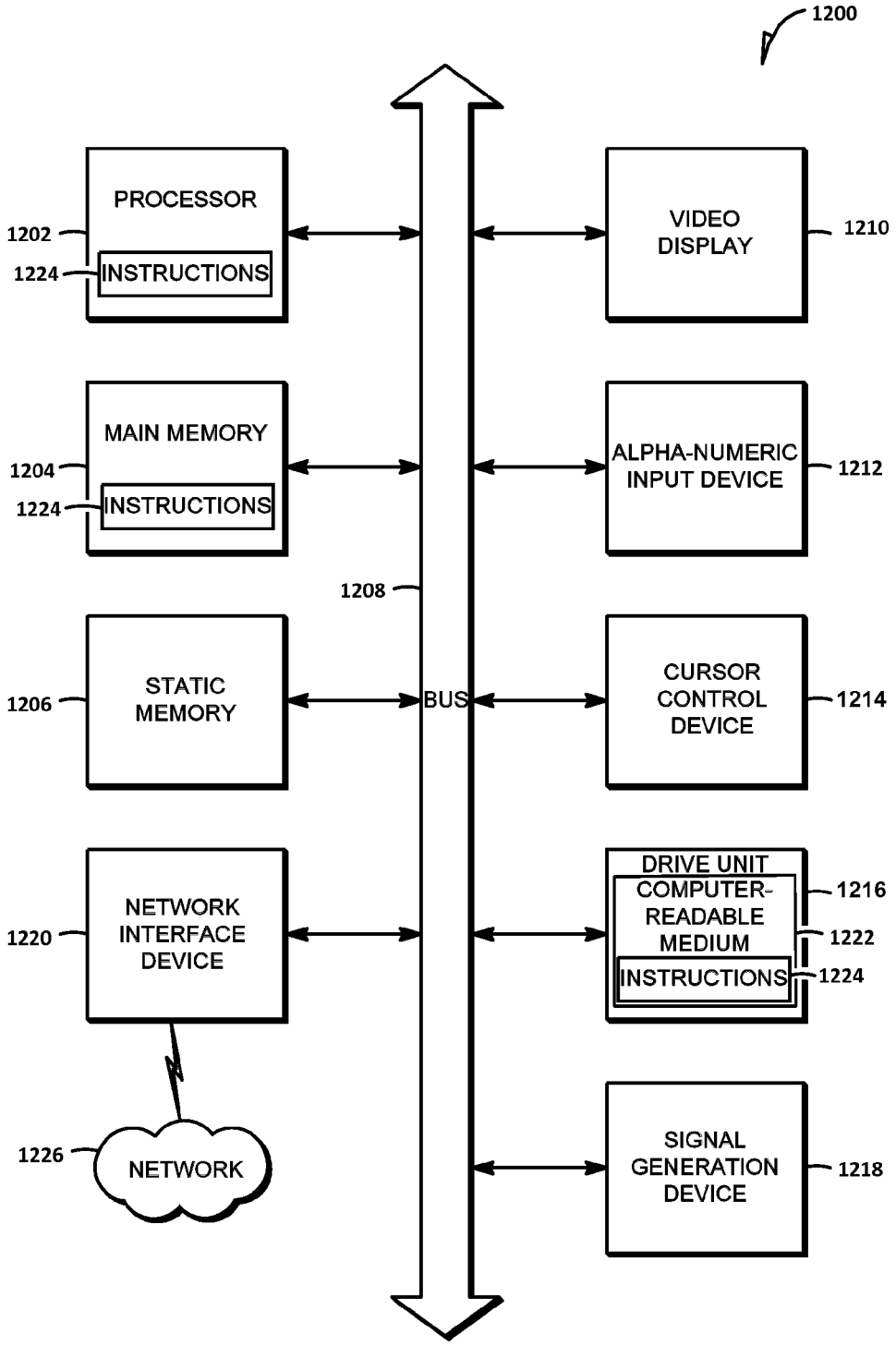
FIG. 12 is a block diagram illustrating components of a machine, according to some example embodiments, able to read instructions from a machine-readable medium and perform any one or more of the methodologies discussed herein.

FIG. 12 is a block diagram illustrating components of a machine 1200, according to some example embodiments, able to read instructions from a machine-readable medium (e.g., a machine-readable storage medium, a computer-readable storage medium, or any suitable combination thereof) and perform any one or more of the methodologies discussed herein, in whole or in part. Specifically, FIG. 12 shows a diagrammatic representation of the machine 1200 in the example form of a computer system and within which instructions 1224 (e.g., software, a program, an application, an applet, an app, or other executable code) for causing the machine 1200 to perform any one or more of the methodologies discussed herein may be executed, in whole or in part. In alternative embodiments, the machine 1200 operates as a standalone device or may be connected (e.g., networked) to other machines. In a networked deployment, the machine 1200 may operate in the capacity of a server machine or a client machine in a server-client network environment, or as a peer machine in a distributed (e.g., peer-to-peer) network environment. The machine 1200 may be a server computer, a client computer, a personal computer (PC), a tablet computer, a laptop computer, a netbook, a set-top box (STB), a personal digital assistant (PDA), a cellular telephone, a smartphone, a web appliance, a network router, a network switch, a network bridge, or any machine capable of executing the instructions 1224, sequentially or otherwise, that specify actions to be taken by that machine.

Further, while only a single machine is illustrated, the term "machine" shall also be taken to include a collection of machines that individually or jointly execute the instructions 1224 to perform all or part of any one or more of the methodologies discussed herein.

The machine 1200 includes a processor 1202 (e.g., a central processing unit (CPU), a graphics processing unit (GPU), a digital signal processor (DSP), an application specific integrated circuit (ASIC), a radio-frequency integrated circuit (RFIC), or any suitable combination thereof), a main memory 1204, and a static memory 1206, which are configured to communicate with each other via a bus 1208. The machine 1200 may further include a graphics display 1210 (e.g., a plasma display panel (PDP), a light emitting diode (LED) display, a liquid crystal display (LCD), a projector, or a cathode ray tube (CRT)). The machine 1200 may also include an alphanumeric input device 1212 (e.g., a keyboard), a cursor control device 1214 (e.g., a mouse, a touchpad, a trackball, a joystick, a motion sensor, or other pointing instrument), a storage unit 1216, a signal generation device 1218 (e.g., a speaker), and a network interface device 1220.

The storage unit 1216 includes a machine-readable medium 1222 on which is stored the instructions 1224 embodying any one or more of the methodologies or functions described herein. The instructions 1224 may also reside, completely or at least partially, within the main memory 1204, within the processor 1202 (e.g., within the processor's cache memory), or both, during execution thereof by the machine 1200. Accordingly, the main memory 1204 and the processor 1202 may be considered as machine-readable media. The instructions 1224 may be transmitted or received over a network 1226 (e.g., network 108) via the network interface device 1220.

As used herein, the term "memory" refers to a machine-readable medium able to store data temporarily or permanently and may be taken to include, but not be limited to, random-access memory (RAM), read-only memory (ROM), buffer memory, flash memory, and cache memory. While the machine-readable medium 1222 is shown in an example embodiment to be a single medium, the term "machine-readable medium" should be taken to include a single medium or multiple media (e.g., a centralized or distributed database, or associated caches and servers) able to store instructions. The term "machine-readable medium" shall also be taken to include any medium, or combination of multiple media, that is capable of storing instructions for execution by a machine (e.g., machine 1200), such that the instructions, when executed by one or more processors of the machine (e.g., processor 1202), cause the machine to perform any one or more of the methodologies described herein. Accordingly, a "machine-readable medium" refers to a single storage apparatus or device, as well as "cloud-based" storage systems or storage networks that include multiple storage apparatus or devices. The term "machine-readable medium" shall accordingly be taken to include, but not be limited to, one or more data repositories in the form of a solid-state memory, an optical medium, a magnetic medium, or any suitable combination thereof.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of components, modules, or mechanisms. Modules may constitute either software modules (e.g., code embodied on a machine-readable medium or in a transmission signal) or hardware modules. A "hardware module" is a tangible unit capable of performing certain operations and may be configured or arranged in a certain physical manner. In various example embodiments, one or more computer systems (e.g., a standalone computer system, a client computer system, or a server computer system) or one or more hardware modules of a computer system (e.g., a processor or a group of processors) may be configured by software (e.g., an application or application portion) as a hardware module that operates to perform certain operations as described herein.

In some embodiments, a hardware module may be implemented mechanically, electronically, or any suitable combination thereof. For example, a hardware module may include dedicated circuitry or logic that is permanently configured to perform certain operations. For example, a hardware module may be a special-purpose processor, such as a field programmable gate array (FPGA) or an ASIC. A hardware module may also include programmable logic or circuitry that is temporarily configured by software to perform certain operations. For example, a hardware module may include software encompassed within a general-purpose processor or other programmable processor. It will be appreciated that the decision to implement a hardware module mechanically, in dedicated and permanently configured circuitry, or in temporarily configured circuitry (e.g., configured by software) may be driven by cost and time considerations.

Accordingly, the phrase "hardware module" should be understood to encompass a tangible entity, be that an entity that is physically constructed, permanently configured (e.g., hardwired), or temporarily configured (e.g., programmed) to operate in a certain manner or to perform certain operations described herein. As used herein, "hardware-implemented module" refers to a hardware module. Considering embodiments in which hardware modules are temporarily configured (e.g., programmed), each of the hardware modules need not be configured or instantiated at any one instance in time. For example, where a hardware module comprises a general-purpose processor configured by software to become a special-purpose processor, the general-purpose processor may be configured as respectively different special-purpose processors (e.g., comprising different hardware modules) at different times. Software may accordingly configure a processor, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple hardware modules exist contemporaneously, communications may be achieved through signal transmission (e.g., over appropriate circuits and buses) between or among two or more of the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions described herein. As used herein, "processor-implemented module" refers to a hardware module implemented using one or more processors.

Similarly, the methods described herein may be at least partially processor-implemented, a processor being an example of hardware. For example, at least some of the operations of a method may be performed by one or more processors or processor-implemented modules. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an application program interface (API)).

The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other example embodiments, the one or more processors or processor-implemented modules may be distributed across a number of geographic locations.

Some portions of the subject matter discussed herein may be presented in terms of algorithms or symbolic representations of operations on data stored as bits or binary digital signals within a machine memory (e.g., a computer memory). Such algorithms or symbolic representations are examples of techniques used by those of ordinary skill in the data processing arts to convey the substance of their work to others skilled in the art. As used herein, an "algorithm" is a self-consistent sequence of operations or similar processing leading to a desired result. In this context, algorithms and operations involve physical manipulation of physical quantities. Typically, but not necessarily, such quantities may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," or the like. These words, however, are merely convenient labels and are to be associated with appropriate physical quantities.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or any suitable combination thereof), registers, or other machine components that receive, store, transmit, or display information. Furthermore, unless specifically stated otherwise, the terms "a" or "an" are herein used, as is common in patent documents, to include one or more than one instance. Finally, as used herein, the conjunction "or" refers to a non-exclusive "or," unless specifically stated otherwise.

What is claimed is:

1. A computer-implemented method comprising:

receiving, from a plurality of devices, analytics data describing user interactions with a physical object, the analytics data including pose data indicating locations on the physical object where optical sensors of the plurality of devices were directed while users interacted with the physical object as well as time durations that the optical sensors were directed at the locations on the physical object;

determining, based on the analytics data, a frequency that users of the plurality of devices looked at the locations of the physical object;

generating, by a computer processor, a visualization content dataset for the physical object, the visualization content data set comprising a set of images of the physical object and corresponding analytics virtual object models to be engaged with each image of the physical object, the analytics virtual object model for each image indicating a frequency that users of the plurality of devices looked at the locations of the physical object captured in the image; and transmitting the visualization content dataset for the physical object to at least a first device, wherein the first device uses the visualization content dataset to render a heat-map over a live image of the physical object captured by an optical sensor of the first device, the heat map indicating the frequency that users of the plurality of devices looked at the locations of the physical object captured in the live image.

2. The computer-implemented method of claim 1, further comprising:

generating, for each image of the physical object, the analytics virtual object model indicating the frequency that users of the plurality of device looked at the locations of the physical object captured in the image.

3. The computer-implemented method of claim 1, further comprising:

determining a pose estimation of a device relative to the physical object, a pose duration of the device relative to the physical object, a pose orientation of the device relative to the physical object, and a pose interaction of the device relative to the physical object.

4. The computer-implemented method of claim 3, wherein the pose estimation comprises a location on the physical object aimed at by the device;

wherein the pose duration comprises a time duration within which the device is aimed at a same location on the physical object;

wherein the pose orientation comprises an orientation of the device aimed at the physical object; and wherein the pose interaction comprises interactions of the user on the device with respect to the physical object.

5. The computer-implemented method of claim 4, further comprising:

generating the visualization content dataset for multiple devices based on the pose estimation, the pose duration, the pose orientation, and the pose interaction from multiple devices.

6. The computer-implemented method of claim 4, further comprising:

generating the visualization content dataset for the device based on the pose estimation, the pose duration, the pose orientation, and the pose interaction from the device.

7. The computer-implemented method of claim 1, further comprising:

storing a primary content dataset and a contextual content dataset, the primary content dataset comprising a first set of images and corresponding analytics virtual object models, the contextual content dataset comprising a second set of images and corresponding analytics virtual object models.

8. The computer-implemented method of claim 7, further comprising:

determining that a captured image received from a device is not recognized in the primary content dataset; and generating the contextual content dataset for the device.

9. The computer-implemented method of claim 1, wherein the analytics data comprises usage conditions of a device, the usage conditions of the device comprising social information of a user of the device, location usage information, and time information of the device.

10. A non-transitory computer-readable medium storing instructions that, when executed by one or more computer processors of a machine, cause the machine to:

receive, from a plurality of devices, analytics data describing user interactions with a physical object, the analytics data including pose data indicating locations on the physical object where optical sensors of the plurality of devices were directed while users interacted with the physical object as well as time durations that the optical sensors were directed at the locations on the physical object;

determine, based on the analytics data, a frequency that users of the plurality of devices looked at the locations of the physical object;

generate a visualization content dataset for the physical object, the visualization content data set comprising a set of images of the physical object and corresponding analytics virtual object models to be engaged with each image of the physical object, the analytics virtual object model for each image indicating a frequency that users of the plurality of devices looked at the locations of the physical object captured in the image; and transmitting the visualization content dataset for the physical object to at least a first device, wherein the first device uses the visualization content dataset to render a heat-map over a live image of the physical object captured by an optical sensor of the first device, the heat map indicating the frequency that users of the plurality of devices looked at the locations of the physical object captured in the live image.

11. A server comprising:

one or more computer processors; and one or more computer-readable mediums storing instructions that, when executed by the one or more computer processors, cause the server to:

receive, from a plurality of devices, analytics data describing user interactions with a physical object, the analytics data including pose data indicating locations on the physical object where optical sensors of the plurality of devices were directed while users interacted with the physical object as well as time durations that the optical sensors were directed at the locations on the physical object;

determine, based on the analytics data, a frequency that users of the plurality of devices looked at the locations of the physical object;

generate a visualization content dataset for the physical object, the visualization content data set comprising a set of images of the physical object and corresponding analytics virtual object models to be engaged with each image of the physical object, the analytics virtual object model for each image indicating a frequency that users of the plurality of devices looked at the locations of the physical object captured in the image; and transmit the visualization content dataset for the physical object to at least a first device, wherein the first device uses the visualization content dataset to render a heat-map over a live image of the physical object captured by an optical sensor of the first device, the heat map indicating the frequency that users of the plurality of devices looked at the locations of the physical object captured in the live image.

12. The server of claim 11, wherein the instructions further cause the server to:

generate, for each image of the physical object, the analytics virtual object model indicating the frequency that users of the plurality of device looked at the locations of the physical object captured in the image.

13. The server of claim 11, wherein the instructions further cause the server to:

determine a pose estimation of a device relative to the physical object, a pose duration of the device relative to the physical object, a pose orientation of the device relative to the physical object, and a pose interaction of the device relative to the physical object.

14. The server of claim 13, wherein the pose estimation comprises a location on the physical object aimed at by the device;

wherein the pose duration comprises a time duration within which the device is aimed at a same location on the physical object;

wherein the pose orientation comprises an orientation of the device aimed at the physical object; and wherein the pose interaction comprises interactions of the user on the device with respect to the physical object.

15. The server of claim 14, wherein the instructions further cause the server to:

generate the visualization content dataset for multiple devices based on the pose estimation, the pose duration, the pose orientation, and the pose interaction from multiple devices.

16. The server of claim 14, wherein the instructions further cause the server to:

generate the visualization content dataset for the device based on the pose estimation, the pose duration, the pose orientation, and the pose interaction from the device.

17. The server of claim 11, wherein the instructions further cause the server to:

store a primary content dataset and a contextual content dataset, the primary content dataset comprising a first set of images and corresponding analytics virtual object models, the contextual content dataset comprising a second set of images and corresponding analytics virtual object models.

18. The server of claim 17, wherein the instructions further cause server to:

determine that a captured image received from a device is not recognized in the primary content dataset; and generate the contextual content dataset for the device.

19. The server of claim 11, wherein the analytics data comprises usage conditions of a device.

20. The server of claim 19, wherein the usage conditions of the device comprises social information of a user of the device, location usage information, and time information of the device.

* * * * *